US007938668B2

(12) United States Patent
Chen et al.

(10) Patent No.: US 7,938,668 B2
(45) Date of Patent: May 10, 2011

(54) CABLE CONNECTOR ASSEMBLY HAVING A SPACER AND A BRACKET

(75) Inventors: Hong-Ji Chen, Kunshan (CN); Su-Feng Liu, Kunshan (CN); Chin-Te Lai, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/907,053

(22) Filed: Oct. 19, 2010

(65) Prior Publication Data

US 2011/0034086 A1 Feb. 10, 2011

Related U.S. Application Data

(63) Continuation of application No. 12/432,766, filed on Apr. 30, 2009, now Pat. No. 7,815,459.

(30) Foreign Application Priority Data

Apr. 30, 2008 (CN) ..... 2008 2 0035877

(51) Int. Cl.
*H01R 13/627* (2006.01)

(52) U.S. Cl. ..... 439/351

(58) Field of Classification Search ..... 439/351, 439/355, 367, 676, 404
See application file for complete search history.

(56) References Cited

U.S. PATENT DOCUMENTS

| | | | | |
|---|---|---|---|---|
| 7,410,382 | B2 * | 8/2008 | Wu | 439/358 |
| 7,815,459 | B2 * | 10/2010 | Chen et al. | 439/351 |
| 2008/0003863 | A1 * | 1/2008 | Wu | 439/358 |
| 2010/0159740 | A1 * | 6/2010 | Zhang | 439/499 |

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

A cable connector assembly (100) comprises: an insulative housing (1) defining a base portion, a plurality of contacts (2) received in the insulative housing, a cover (6) attached to the base portion of the insulative housing, a cable (5) connected to the contacts electrically, a spacer (3) received in a notch recessed forwards from a rear surface of the base portion, and a bracket (4) assembled to a back end of the insulative housing and disposed in the receiving space. The cover is hollow and assuming a cap-shaped, and the cover and the insulative housing form a receiving space, one end of the cable and the contacts is received and connected electrically in the receiving space. One lateral side of the cable connector assembly comprises a hole, and the cable extends out of the receiving space through the hole.

19 Claims, 4 Drawing Sheets

CABLE CONNECTOR ASSEMBLY HAVING A SPACER AND A BRACKET

This application is a continuation application of application Ser. No. 12/432,766 filed on Apr. 30, 2009.

BACKGROUND OF THE INVENTION

1. Field of the Invention

The present invention relates to a cable connector assembly, and more particularly to a cable connector assembly used for high-speed signal transmission.

2. Description of Prior Art

There exists in the art a cable connector assembly known as a Serial Advanced Technology Attachment (Serial ATA) connector which is generally used for such as notebook computer and storage peripherals. Especially, the Serial ATA connectors are featured in fewer counts of electrical contacts than other conventional electrical connectors and are relatively tiny in configuration.

U.S. Pat. No. 7,318,741, for example, discloses such a cable connector assembly, which comprises an insulative housing with a mating portion, a plurality of contacts received in the housing, a cable connected to the contacts electrically, a cover and an insulator. The cover further comprises an upper cover and a lower cover, which are combined by screws. One end of the cable is over-molded by the insulator and received in the cover. Conclusively, the cable connector assembly is formed by so many components, and the assembly procedure and the product structure of the connector will become complex, the cost of the cable connector assembly will be high, accordingly.

Hence, it is desirable to have an improved cable connector assembly to overcome the above-mentioned disadvantages of the prior art.

BRIEF SUMMARY OF THE INVENTION

Accordingly, the object of the present invention is to provide a cable connector assembly with a simple structure and an improved cover to assembly.

In order to achieve the above-mentioned object, a cable connector assembly comprises: an insulative housing defining a base portion, a plurality of contacts received in the insulative housing, a cover attached to the base portion of the insulative housing, a cable connected to the contacts electrically, a spacer received in a notch recessed forwards from a rear surface of the base portion, and a bracket assembled to a back end of the insulative housing and disposed in the receiving space. The cover is hollow and assuming a cap-shaped, and the cover and the insulative housing form a receiving space, one end of the cable and the contacts is received and connected electrically in the receiving space. One lateral side of the cable connector assembly comprises a hole, and the cable extends out of the receiving space through the hole.

Other objects, advantages and novel features of the invention will become more apparent from the following detailed description of the present embodiment when taken in conjunction with the accompanying drawings.

DETAILED DESCRIPTION OF THE INVENTION

Figure 1:
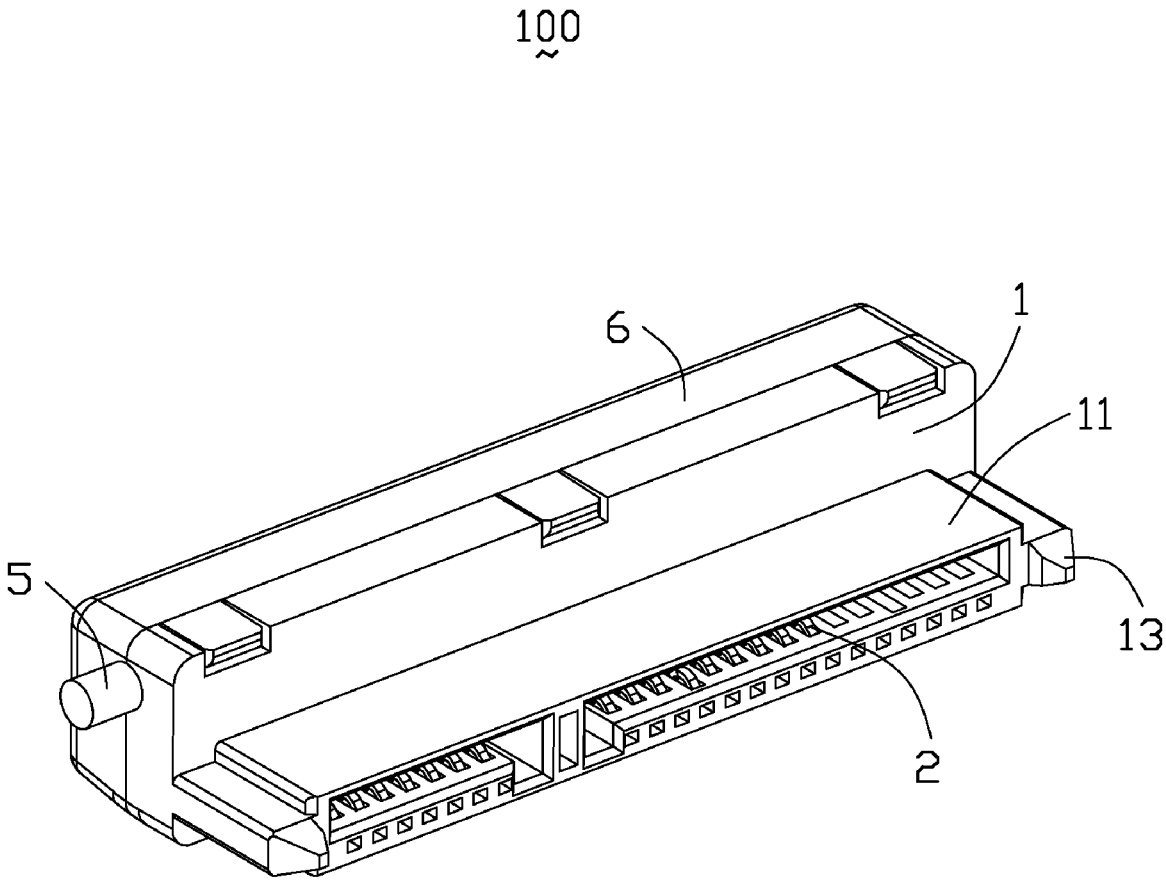
FIG. 1 is a perspective view of a cable connector assembly in accordance with the present invention.

Reference will now be made to the drawing figures to describe the present invention in detail.

Referring to FIG. 1 to FIG. 4, a cable connector assembly 100 comprises an insulative housing 1, a plurality of contacts 2 received in the housing 1, a spacer 3 separating the contacts 2, a bracket 4 held on the housing 1, a cable 5 connected to the contacts 2 and a cover 6 engaging with the housing 1.

The insulative housing 1 comprises an elongated base portion 10, a mating portion 11 extending from one side of the base portion 10 and a pair of guiding post 13 disposed at the opposite sides of the mating portion 11. The base portion 11 forms a plurality of step portions 101 on the top surface and bottom surface thereof, and one side of the base portion 11 comprises a half hole 102 for receiving the cable 5. The half hole 102 has a tuber 103 therein for clipping the cable 5. The base portion 11 further comprises a retaining groove 104 which assumes an H-shaped. The elongated mating portion 11 comprises a plurality of passageway 111 for receiving the contacts 2 and a receiving room 110 for receiving a butting connector (not shown), and the passageways 111 are arranged in a line transversely and thread through the mating portion 11 and the base portion 10. The insulative housing 1 further comprises a pair of retaining groove 112 located at the opposite sides of the passageway 111 and extend in a vertical direction. The base portion 10 defines a notch 105 recessed backwards from a front surface 106 thereof.

Figure 2:
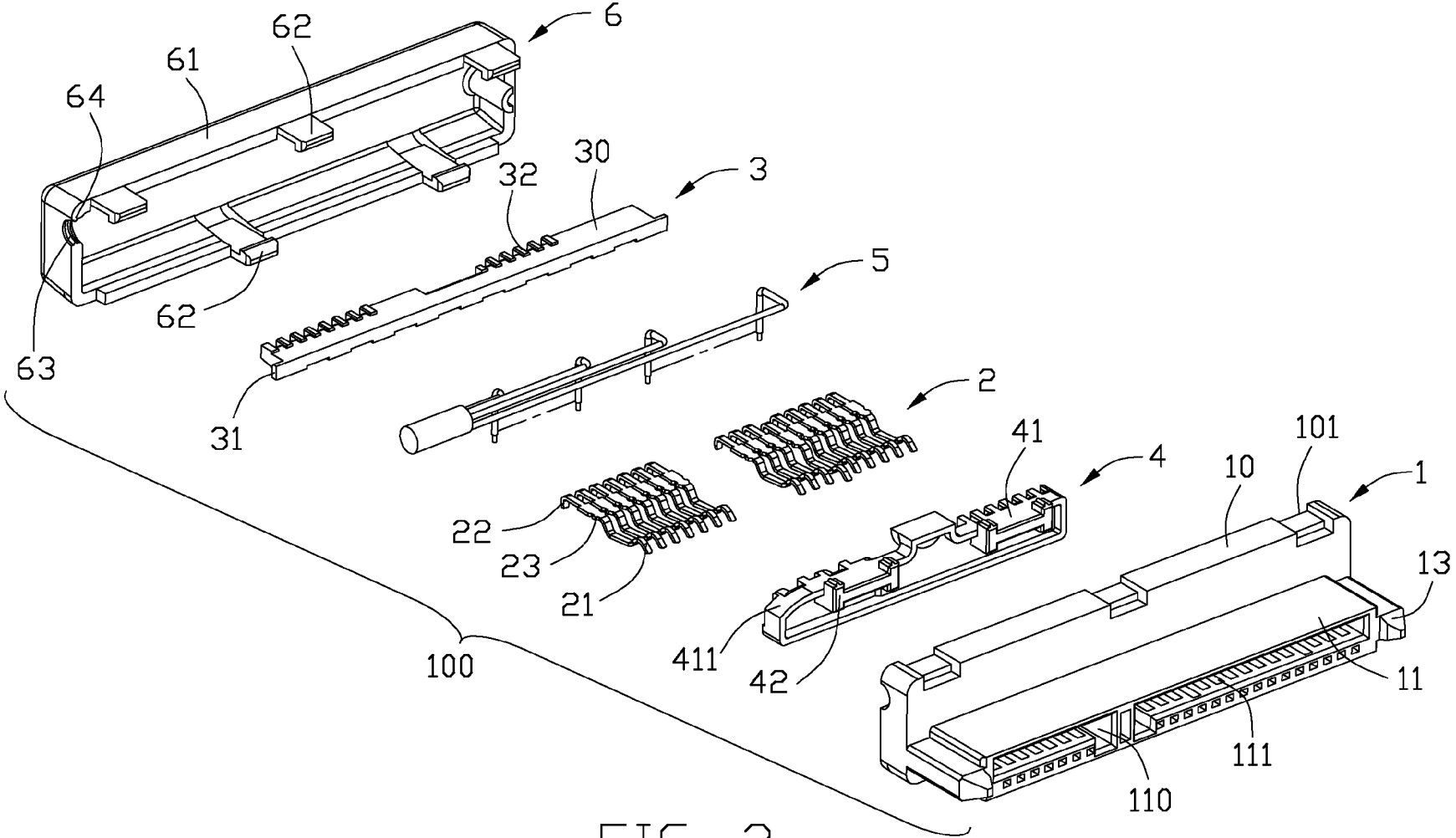
FIG. 2 is an exploded, perspective view of the cable connector assembly shown in FIG. 1.
Figure 3:
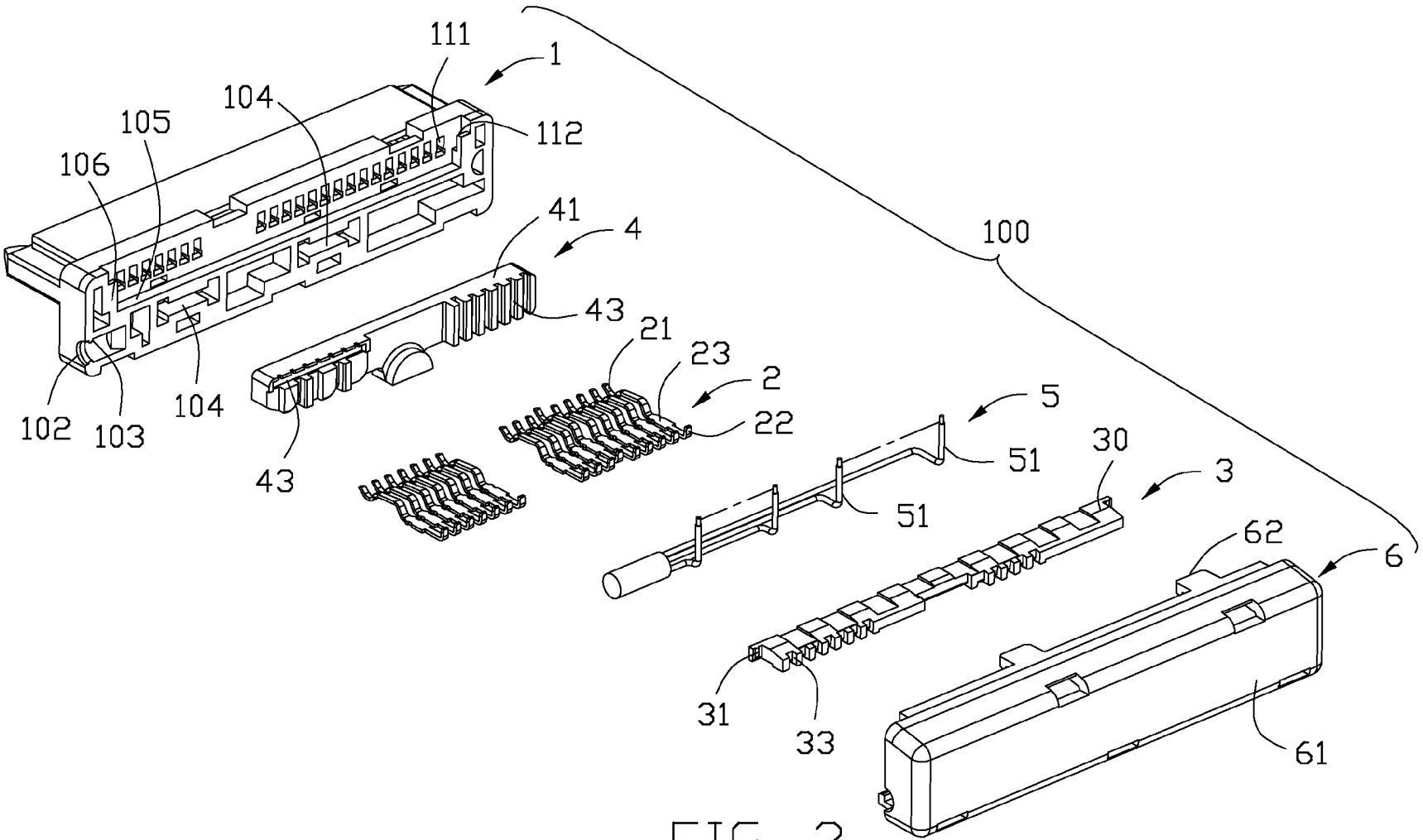
FIG. 3 is a view similar to the FIG. 2, but taken from other aspect.

Referring to FIG. 1 to FIG. 3, the cover 6 is hollow and assumes a cap-shaped, which is disposed at the front portion of the cable connector assembly 100. The cover 6 is attached to the insulative housing 1 in a front-to-back direction to form a receiving space (not labeled), and the bracket 4, one end of the cable 5 and the contacts 2 are all received in the receiving space, that leads to the outline of cable assembly connector 100 formed just by the cover 6 and the insulative housing 1. The cover 6 is made by an insulative material and comprises a shielding portion 61 and a plurality of latches 62 extending backwardly from the shielding portion 61. The latches 62 engage with the step portions 101 of the insulative housing 1, which are embedded by the base portion 10 to prevent the cover moving in a right-to-left direction. The cover 6 further comprises another half hole 63 corresponding with the half hole 102 of the insulative housing 1, and they have the same structure and size to form a full hole.

Referring to FIG. 1 to FIG. 4, the contacts 2 are received in the passageway 111 of the insulative housing 1, and each contact comprises a contacting portion 21, a tail portion 22 and a connecting portion 23. The contacting portion 21 extends into the receiving room 110. The connecting portion 23 connects the tail portion 22 and the contacting portion 21 and is held by the insulative housing 1. The tail portion 22 extends into the receiving space (not labeled).

Figure 4:
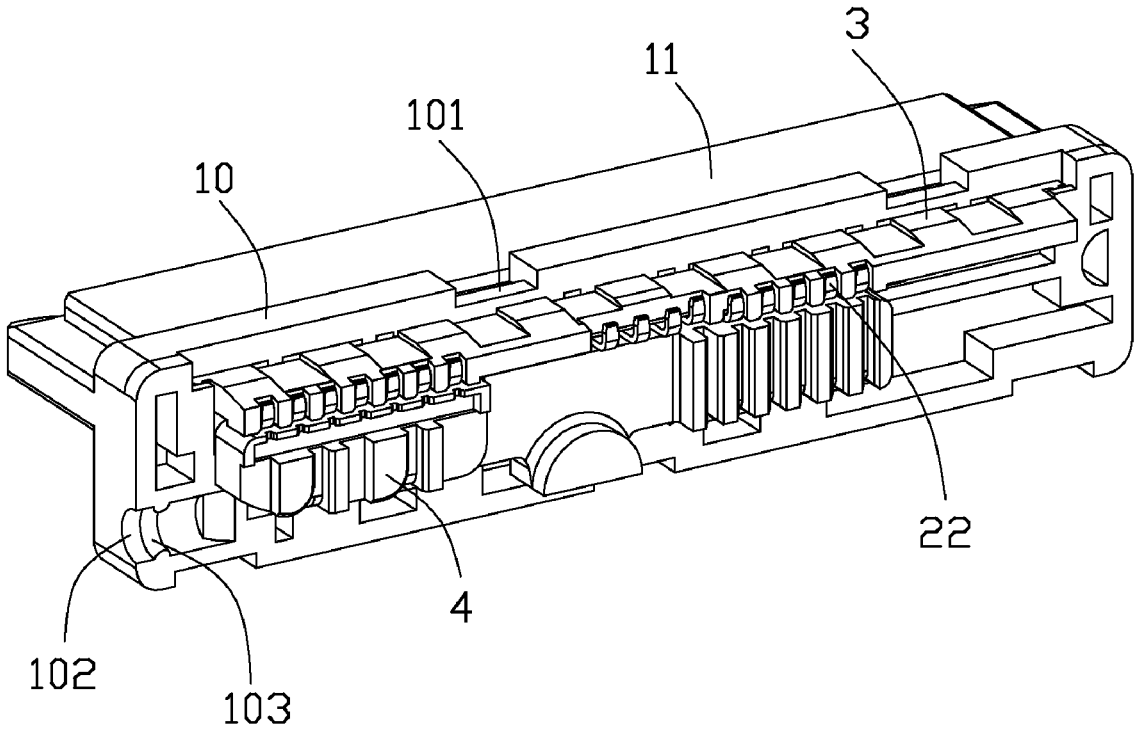
FIG. 4 is a perspective view of the cable connector assembly without cover shown in FIG. 1.

Referring to FIG. 2 to FIG. 4, the spacer 3 is attached to the insulative housing 1 and located between the tail portion 22 of the contact 2 and the base portion 10 of the insulative housing 1, and it comprises a main portion 30, a pair of guiding portions 31 located at the opposite sides of the main portion 30 and a spacing portion 32 located at the front edge of the main portion 30. The guiding portion 31 is inserted into the retaining groove 112 in the vertical direction. The spacing portion 32 has a plurality of gaps 33 for receiving the tail portion 22 of the contact 2.

Referring to FIG. 1 to FIG. 3, the cable 5 extends out of the cable connector assembly 100 through the hole formed by the half hole 63 of the cover 6 and the half hole 102 of the insulative housing 1. The cable 5 comprises a plurality of core wires 51 connecting with the tail portion 22 of the contact 2 electrically. The cable 5 is clipped by the tuber 103 to prevent the cable being pulled out of the cable connector 100 easily.

Referring to FIG. 2 to FIG. 4, the bracket 4 is mounted to receiving space for separating the core wires 51, and it comprises a base 41, a holding member 42 located at the rear portion of the base 41 and a plurality of barriers 43 located at the front portion of the base 41 to form unlabeled corresponding passages each between every adjacent two barriers. The base 41, next to the hole (not labeled), forms an arc surface 411 to prevent the cable 5 being broken. The passages beside the barriers 43 is used to receive the core wires 51 and correspond to the gaps 32 of the spacer 3. The holding member 42 assumes an H-shaped for mating with the H-shaped retaining groove 104 of the insulative housing 1.

The assembly procedure of the cable connector assembly 100 as follows: the contacts 2 are inserted into the passageway 111 and retained by the insulative housing 1, the guiding portion 32 of the spacer 3 is inserted into the retaining groove 112, the tail portion 22 of the contact 2 is received in the gap 33 of the spacer, the bracket 4 engages with insulative housing 1 by the H-shaped holding member 42, the core wires 51 are soldered to the tail portion 22, and the cover 6 is attached to the insulative housing 1 to finish the assembly procedure.

It is obvious that the components of cable connector assembly 100 are much fewer, the cover 6 of the connector 100 can engage with housing 1 without other component for dismounting conveniently, and the cable 5 is soldered to the contact 2 directly in the receiving space formed by insulative housing 1 and cover 6 to reduce the assembly procedure, for example, the over-molding method.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A cable connector assembly comprising:

an insulative housing defining a base portion and a mating portion extending from one side of the base portion, and the mating portion divided into two mating areas with an L-shaped cross-section;

a plurality of contacts received in the insulative housing and arranged in a line transversely;

a cable with a plurality of wires connected to the contacts electrically;

a spacer assembled to a rear end of the insulative housing and cooperated with the base portion;

a bracket located behind the insulative housing and protruding into the base portion with a holding member; and a cap-shaped cover engaging with the insulative housing;

wherein the cover and the mating portion are located at the opposite sides of the base portion, a receiving space is defined by the insulative housing and the cover, and the wires are extending from the corresponding contacts to form a convergent group and then extending through a hole on one side of the cable connector assembly.

2. The cable connector assembly as claimed in claim 1, wherein the base portion comprises a plurality of step portions, and the cover comprises a plurality of latches for engaging with the step portions.

3. The cable connector assembly as claimed in claim 2, wherein the cover is attached to the insulative housing in a front-to-back direction to form the receiving space.

4. The cable connector assembly as claimed in claim 1, wherein the cable is received in the receiving space and then extends out of the receiving space through the hole.

5. The cable connector assembly as claimed in claim 4, wherein the hole is defined in at least one of the insulative housing and the cover.

6. The cable connector assembly as claimed in claim 1, wherein the bracket comprises a base and the holding member, and the insulative housing comprises a retaining groove mating with the holding member.

7. The cable connector assembly as claimed in claim 6, wherein the base of the bracket forms an arc surface for touching with the cable.

8. The cable connector assembly as claimed in claim 6, wherein the spacer has a plurality of gaps, and the bracket comprises a plurality of barriers corresponding to the gaps of the spacer.

9. The cable connector assembly as claimed in claim 8, wherein the wires of the cable are separated by the barriers.

10. The cable connector assembly as claimed in claim 6, wherein each contact comprises a tail portion, and a neighboring section behind the tail portion is adjacent to the spacer, and the tail portion is suspended beyond the spacer.

11. The cable connector assembly as claimed in claim 10, wherein the insulative housing comprises a pair of retaining grooves extending in a vertical direction, and the spacer is inserted into the retaining grooves.

12. A cable connector assembly comprises:

an insulative housing defining a base portion;

a plurality of contacts received in the insulative housing;

a cover attached to the base portion of the insulative housing;

a cable connected to the contacts electrically;

the cover being hollow and assuming a cap-shaped, and the cover and the insulative housing forming a receiving space, one end of the cable and the contacts being received and connected electrically in the receiving space;

a spacer received in a notch recessed forwards from a rear surface of the base portion; and a bracket assembled to a back end of the insulative housing and disposed in the receiving space;

wherein one lateral side of the cable connector assembly comprises a hole, and the cable extends out of the receiving space through the hole.

13. The cable connector assembly as claimed in claim 12, wherein the base portion of the insulative housing comprises step portions, and the cover comprises a plurality of latches for engaging with the step portions, which are embedded by the base portion.

14. The cable connector assembly as claimed in claim 12, wherein the spacer forms a plurality of gaps for receiving tail portions of the contacts, and the bracket forms a plurality of barriers corresponding to the gaps of the spacer.

15. A cable connector assembly comprising:

an insulative housing having first and second mating ports spaced from each other in a transverse direction and defining an L-shaped cross-section having a vertical section and a horizontal section located in front of the vertical section and defining said first and second mating ports thereof;

first and second sets of contacts disposed in the housing corresponding said two spaced mating ports, each of said contacts defining a contacting section exposed in the corresponding mating port, and a tail section extending upon a rear side of the vertical section and in a vertical direction perpendicular to said transverse direction;

an insulative spacer located on the rear side of the vertical section to restrain the contacts; and first and second sets of wires having corresponding inner conductors respectively mechanically and electrically connected to the tail sections of the corresponding contacts; wherein said first and second sets of wires both extend behind the vertical section in the same transverse direction before being joined together as a single cable and commonly leaving away from the housing.

16. The cable connector assembly as claimed in claim 15, wherein an exit of the housing where said cable leaves, is located proximate an end of the housing in said transverse direction.

17. The cable connector assembly as claimed in claim 16, further including a cover mounted to the rear side of the housing to cover both the transversely extending first and second set of wires before said cable leaves away from the housing.

18. The cable connector assembly as claimed in claim 17, wherein the cover defines a cutout through which at least a portion of said cable extends.

19. The cable connector assembly as claimed in claim 18, wherein said cover grasps the housing for holding said transversely extending first and second set of wires therebetween in front-to-back direction perpendicular to both said transverse direction and said vertical direction.

* * * * *